United States Patent [19]

McFann et al.

[11] Patent Number: 4,949,998

[45] Date of Patent: Aug. 21, 1990

[54] HOLDER FOR TRANSFER MEDIUM FOR CHECKS

[75] Inventors: C. Joseph McFann, Ridgefield, Conn.; Gerald A. Callahan, Framingham, Mass.

[73] Assignee: Transkrit Corporation, Brewster, N.Y.

[21] Appl. No.: 246,094

[22] Filed: Sep. 16, 1988

[51] Int. Cl.[5] ..... B41L 3/12; B41L 3/00

[52] U.S. Cl. ..... 282/29 B; 282/27 R; 283/58

[58] Field of Search ..... 282/27 R, 9 R, 29 A, 282/29 B, 28 R, 28 A; 283/58; 402/8, 79

[56] References Cited

U.S. PATENT DOCUMENTS

| | | | |
|---|---|---|---|
| 1,169,813 | 2/1916 | Hazel | 282/29 R X |
| 1,206,745 | 11/1916 | Winter | 282/27 R |
| 1,216,770 | 2/1917 | Bonham | 282/29 R X |
| 4,201,402 | 5/1980 | Aziz et al. | 282/29 B X |

*Primary Examiner*—Paul A. Bell

*Attorney, Agent, or Firm*—Robin, Blecker, Daley & Driscoll

[57] ABSTRACT

A transfer medium holder for transferring the information being recorded on a preselected area of a check to a record, the holder including a support member supporting the transfer medium and an alignment means which aligns the transfer medium with the preselected area of the check when the alignment means is brought into engagement with the check.

10 Claims, 2 Drawing Sheets

HOLDER FOR TRANSFER MEDIUM FOR CHECKS

BACKGROUND OF THE INVENTION

This invention relates to a transfer medium holder and, in particular, to a transfer medium holder for use with checks.

There are a number of check management systems in use today wherein the systems are arranged to provide for simultaneous recording on a journal or other record of information being written on a check. Typically, information being entered on a preselected, longitudinally extending area of a check (usually, the area designating the payee and written amount) is imparted to a corresponding longitudinally extending region of the journal.

The journal is provided with a number of such regions (e.g., 26) displaced vertically for entry of the data from a like number of checks. The checks, in turn, are arranged in overlapping or so-called "shingled" fashion so that the preselected longitudinally extending areas of successive checks align with successive vertically displaced longitudinal regions of the journal. Frequently, a ledger card, which may be formed of transfer or pressure sensitive paper such as NCR paper, is inserted between the checks and the journal so as to also capture the information on an associated vertically extending portion of the ledger.

To ensure alignment of the check areas and corresponding journal and ledger card regions and portions, a holder may be provided for holding the checks and journal. The holder has vertically spaced pegs running along one vertical edge and the checks and the journal are provided with holes along their vertical edges or sides. The checks may also be held in a prearranged sequence through gluing in a shingled or stacked fashion. By inserting the journal so that its holes are received by the pegs and then inserting the checks so that their holes are received in certain of the pegs, the preselected areas of successive checks become automatically aligned with successive regions of the journal. The ledger card can then be aligned visually with the appropriate line of the journal and, as a result, the information recorded on the preselected area of each check will be reproduced on the associated portion and region of the ledger and journal, as above described.

In present day systems of the above type, the transfer of the information from each check to the ledger card is via a transfer medium which is supported on the back of each check and is commensurate in area with the preselected area on the face of the check. As a result, after a check is written and removed, the back of the check still retains a remanant strip of the transfer medium. Particularly where the transfer medium is a carbon based medium, this remnant strip is said to obscure the visibility of endorsements which are subsequently applied to the back of the check.

This lessened visibility, in turn, has been said to increase the amount of time it takes to recognize endorsements during the check clearing process. Recent banking legislation aimed at decreasing this processing time has looked to modifications of existing checks and has reduced the willingness of the banking industry to process checks with a transfer medium on their backs. As a result, designers of the above-discussed check management systems are now searching for an alternative to the check transfer strips presently being used.

One proposal for an alternative arrangement is to provide under each check a separate sheet with a transfer medium on its back surface. Writing in the preselected area of the check would thus result in recording on the associated region of the ledger card via the transfer medium on the back surface of the separate sheet. The sheet may then be removed with the check after the check is written. While the use of a separate sheet provides a viable alternative to the use of a transfer medium strip on a check, it also adds significantly to the cost and processing time of the check management system.

Other less expensive approaches are thus being sought. One less expensive approach is disclosed in U.S. Pat. No. 1,206,745 which describes a system for recording preselected areas of individual checks on a ledger. In the system of the '745 patent, a holder of the same size as a check is provided with a longitudinal slot in the same location as the preselected area of the check. A piece of carbon paper is held to the undersurface of the holder spanning the slot. When the check and holder are together situated in overlapping relationship on the ledger, the information being written in the preselected area of the check is transferred to the ledger via the carbon strip in the holder slot. In order to situate each check and the holder over an associated region on the ledger, dash marks are provided on the vertical edges of the ledger, checks and/or holder.

In using the holder of the '745 patent, the user first places the holder behind the check and visibly aligns the holder and/or check until the edges of both are in unison. This places the preselected area of the check in overlapping relationship with the slot in the holder. The user then visibly aligns the dashes on the check and/or holder with the associated dash on the ledger. This situates the preselected check area in overlapping relationship with the associated region on the ledger. The check is then in position to be written and reproduced on the ledger.

Since the above alignment procedures of the '745 patent necessarily rely on the user visibly checking alignments (edges or dashes), they are tedious and make the check writing and recording process slow. As a result, the holder of the '745 patent does not provide an entirely satisfactory alternative to the transfer strips of existing checks.

It is, therefore, a primary object of the present invention to provide a transfer medium holder for checks which eases the difficulty of aligning the transfer medium with a preselected area of each check.

It is a further object of the present invention to provide a transfer medium holder for checks which provides substantially automatic alignment of the transfer medium with a preselected area of each check.

It is a further object of the present invention to provide a transfer medium holder meeting the aforementioned objects in combination with a check management system.

SUMMARY OF THE INVENTION

In accordance with the principles of the present invention, the above and other objectives are realized in a transfer medium holder in which a support member supports a transfer medium and an alignment means is affixed to the support member such that when the support member is placed adjacent a check with the alignment means in engagement with the check, the transfer medium becomes substantially aligned with a preselected area of the check.

In the embodiment of the invention to be disclosed hereinafter, the support member is in the form of a sheet of material. The alignment means comprises a flange which extends from and along substantially the entire length of the upper or lower edge of the sheet and which is bent to face the sheet and thereby also form a guide for bringing the sheet into overlapping relationship with the check. The sheet further comprises a slot of dimension sufficient to encompass the preselected area of the check and in which is supported a carbon paper transfer medium. The holder forms part of a check management system having a peg board holder, frequently a ledger card, a journal or record and a shingled arrangement of checks.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
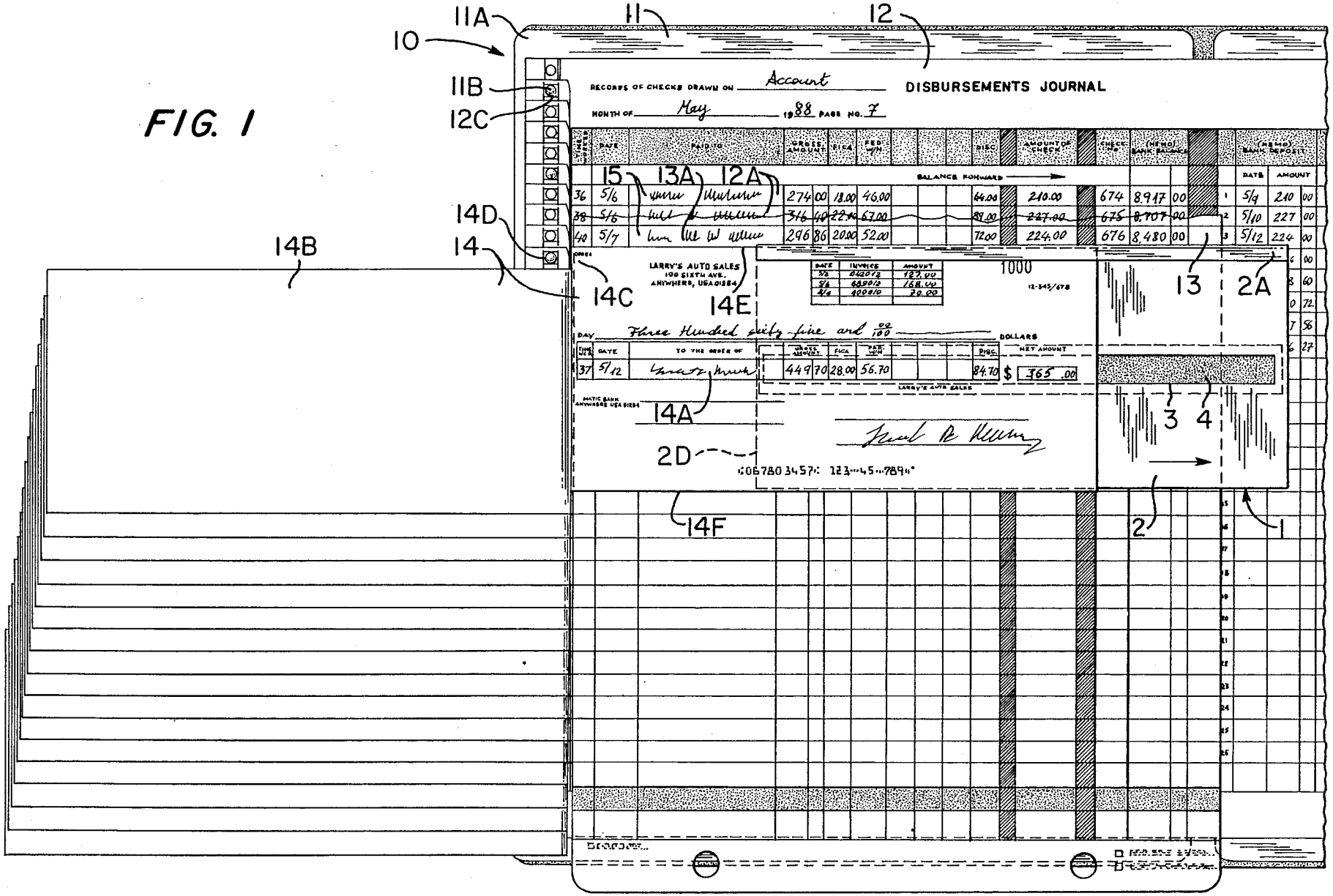
FIG. 1 illustrates a check management system utilizing a transfer medium holder in accordance with the principles of the present invention.

FIG. 1 shows a check management system 10 which utilizes a transfer medium holder 1 in accordance with the principles of the present invention. The check management system 10 comprises a peg board holder 11, a journal or record 12 and a plurality of like checks 14 whose entries are to be recorded in the journal 12.

Each check 14 includes a preselected longitudinally extending area 14A (shown as including the payees name and the net check amount) whose information is to be recorded on an associated longitudinally extending region 12A of the journal 12. In the case shown, this information is also to be recorded on a corresponding longitudinally extending portion 13A of a ledger card 13. The latter card has been inserted between the check 14 and the journal 12 and may be formed from transfer or pressure sensitive paper such as NCR paper. The checks 14 are organized in shingled or vertically overlapping relationship so that the areas 14A of successive checks 14 will overlie successive vertically displaced regions 12A of the journal.

In the specific case of FIG. 1, several checks have been written and removed from the peg board 11, exposing the information 15 recorded on the journal and ledger from the removed checks. Of the remaining checks, the next check 14 to be written is in positioned face up, while the other checks have been turned over about their sides 14C to permit writing of the latter check. As can be seen, the backs 14B of the checks 14 carry no transfer medium which can interfere with the visibility of any endorsements subsequently applied to the checks.

The required alignment between the check areas 14A and the journal regions 12A is achieved by providing pegs 11B on the vertical side 11A of the board 11. The journal, in turn, includes holes 12C for receiving the pegs 11B and securing the journal to the board. Likewise, each check along its side 14C includes holes 14D for receiving certain of the pegs. By proper spacing of the pegs and proper spacing of the holes 14D of the checks, the checks are secured to the board to achieve the aforementioned alignment of the preselected areas 14A of successive checks 14 with successive regions 12A of the journal.

Figure 2:
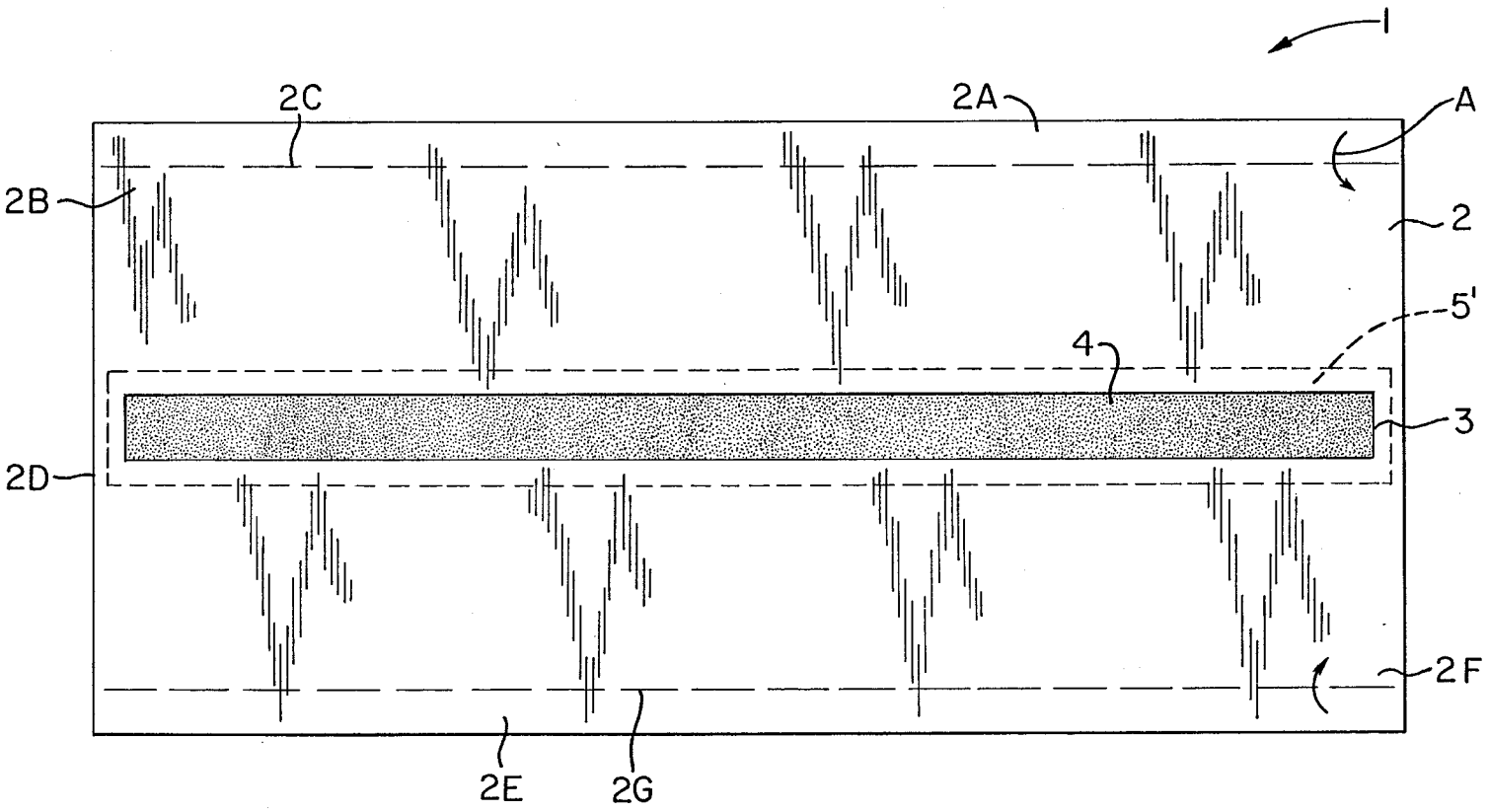
FIG. 2 illustrates the transfer medium holder of FIG. 1 in greater detail.

In order to be able to reproduce the information recorded on each check area 14A of the corresponding region 12A of the journal and on the intervening portion 13A of the ledger card 13, the above-mentioned transfer medium holder 1 is utilized. As shown in FIG. 2, the holder 1 comprises a support member, shown as a sheet of material 2, which has a slot 3 of extent substantially commensurate with the area 14A of the checks 14. Within the slot 3, the support member or material 2 supports a recording medium 4, which typically might be a strip of carbon paper. The medium 4 may be secured by adhesive or other means to the area 5' of the sheet 2 bordering the periphery of the slot 3.

In accordance with the invention, the sheet material 2 also includes a flange 2A which extends from a top portion 2B of the material along a fold line 2C The flange 2A is shown as flat with the plane of the sheet 2 in FIG. 2, but in operative position, it is bent outwardly of the plane of the sheet (as indicated by arrow A) along the fold line 2C to form an alignment means for the holder 1.

More particularly, by suitably positioning the lower edge of the flange 2A defined by the fold line 2C from the slot 3 in the holder 1, the holder 1 when positioned with the flange edge 2C abutting the upper edge 14E of a check 14 will automatically result in the slot 3 and, therefore, the carbon paper 4 being aligned with the preselected area 14A of the check. As a result, with the flange 2A of holder 1 abutting the upper edge of the check, as above-described, and the holder side 2D abutting the edge 14C of the check, the carbon paper 4 of the holder will be commensurate with the entire area 14A of the check. Any writing in the area 14A will thus be transferred by the carbon to the associated portion 13A of the ledger and from the ledger to the associated region 12A of the journal so as to provide the desired reproduction of the writing on the ledger and journal.

In FIG. 1, the holder 1 is shown with the flange 2A engaging the check 14 as the holder is being removed from the check. As is apparent, where the check and holder overlap, the carbon paper 4 in the slot 3 is aligned with the area 14A of the check.

In the illustration in FIG. 1, the flange 2A of the holder 1 is also shown as having been bent so that it is in facing relationship with the sheet 2. The flange thus not only acts as an alignment mechanism, but also as a channel or guide for facilitating sliding of the holder 1 behind the check 14 until the side 2D of the holder abuts the edge 14C of the check.

While the flange 2A of the holder 1 has been adapted to engage the upper edge 14E of the check 14, it is apparent that the flange 2A could have instead been adapted to engage the lower edge 14F of the check 14. In such case, the fold line 2C of the flange 2A would be positioned relative to the slot 3 so that the desired alignment of the slot 3 and check area 14A occurs when the flange edge 2C engages the lower edge 14F of the check 14.

The holder 1 of FIG. 2 may also itself be adapted to allow for aligning engagement of the holder with either the upper or lower edge of the check 14 by providing the sheet 2 with a second flange 2E and a second fold line 2G at the bottom portion 2F of the holder. With this modification, the first flange to 2A would be positioned, as above described, to provide alignment when it is brought into engagement with the upper edge 14E of a check 14 and the second flange 2E would be positioned, also as above-described, to provide alignment when it is brought into engagement with the lower edge 14F of the check 14.

The sheet material 2 of the holder 1 is preferably a relatively thin material having sufficient structural integrity to support the transfer medium 4. Typical materials for the sheet 2 might be clear plastic, paper, thin bristol, tag or vinyl. Also, the transfer medium may be a material other than carbon paper such as, for example, an encapsulated coating.

While the holder 1 of the invention has been illustrated in FIGS. 1 and 2 as having one or more flanges which are folded into place, it is apparent that the holder could be formed with its flanges already in place, thereby avoiding the use of fold lines altogether. This might be desirable where the sheet material 2 is such that it is not readily provided with such fold lines.

It also should be noted that, while it is desirable to provide the slot 3 in the sheet material of the holder to eliminate a material layer between the check and the transfer medium, the holder could also be configured without the slot in the sheet material and still provide satisfactory results. In such case, the transfer medium would be supported on the back surface of the sheet material support member and configured to encompass the check area 14A. The flange or flanges of the holder, in turn, would be positioned relative to the transfer medium to obtain the desired alignment characteristics. With the holder configured in this way, the transfer medium can be a hot waxed spot carbon coating similar to that supported on the backs of presently existing check.

The terminology "transfer medium supported on the support member" is used herein in its broadest sense. Accordingly, it is intended to cover all manners of support including, without limitation, situations where the transfer medium is integral with the support member, where the transfer medium is a separate sheet or strip affixed or connected to the support member, where the transfer medium is a coating applied to the support member or where the transfer medium is a material otherwise carried by the support member.

Finally, it should be appreciated that alignment mechanisms for the holder 1 other than flanges might also be used. Thus, tabs, projections and like arrangements might be employed on the sheet 2 of the holder 1 to provide engagement of the check and result in the desired alignment.

In all cases, it is understood that the above-identified arrangements are merely illustrative of the many possible specific embodiments which represent applications of the present invention. Numerous and varied other arrangements can readily be devised in accordance with the principles of the present invention without departing from the spirit and scope of the invention

What is claimed is:

1. A holder for use in transferring information being recorded on a preselected area of a check to a record, the check having predetermined height and width dimensions with the width dimension being substantially greater than the height dimension, the holder comprising:

a support member having substantially the same width dimension as said predetermined width dimension and a greater height dimension than the portion of said predetermined height dimension from the top edge of the check to the bottom edge of said preselected area;

a transfer medium supported on said support member, said transfer medium being of extent sufficient to encompass said preselected area when aligned with said preselected area;

and alignment means comprising a flange disposed on the upper portion of the width portion of said support member such that when said support member is placed adjacent the check with said flange of said alignment means engaging the top edge of the check said transfer medium becomes aligned with said preselected area of the check.

2. A holder in accordance with claim 1 wherein:

said support member has a fold line in said upper portion of the width portion of said support member, said support member being folded along said fold line to form said flange.

3. A holder in accordance with claim 1 wherein:

said flange extends along substantially the entire length of said upper portion of the width portion of said support member.

4. A holder in accordance with claim 1 wherein:

said flange extends from said upper portion of the width portion of said support member so as to face said support member, thereby forming a channel for guiding said support member into engagement with the check.

5. A holder in accordance with claim 1 wherein:

said support member comprises a sheet of material having a slot of extent sufficient to encompass said preselected area of the check;

and said transfer medium is supported so as to be in said slot.

6. A holder in accordance with claim 5 wherein:

said transfer medium comprises carbon paper.

7. A holder in accordance with claim 1 wherein:

the check has a height dimension greater than said predetermined height dimension;

and said alignment means comprises a further flange extending from the lower portion of the width portion of said support member for engaging the bottom edge of the check.

8. A holder in accordance with claim 1 wherein:

said preselected area of the check is a longitudinally extending area wherein the name of the payee and the net amount of the check is recorded.

9. In combination:

a record having elongated vertically displaced regions;

a plurality of checks each having: an elongated preselected area, and predetermined height and width dimensions with the width dimension being substantially greater than the height dimension;

means for holding the record and the checks so that the checks overlie the record in overlapping vertical displaced relationship and so that the preselected areas of successive checks overlie successive vertically displaced regions of the record;

and a means for use in transferring the information placed on the preselected area of a check to the underlying region of the record comprising: a support member having substantially the same width dimension as said predetermined width dimension and a greater height dimension than the portion of said predetermined height dimension from the top edge of said check to the bottom edge of said preselected area; a transfer medium supported on said support member, said transfer medium being of extent sufficient to encompass said preselected area of said check when aligned with said preselected area; and alignment means comprising a flange disposed on the upper portion of the width portion of said support member such that when said support member is placed adjacent said check with said flange of said alignment means engaging said top edge of said check said transfer medium becomes aligned with the preselected area of said check.

10. A holder for use in transferring information being recorded on a preselected area of a check to a record, the check having predetermined height and width dimensions with the width dimension being substantially greater than the height dimension, the holder comprising:

a support member having substantially the same width dimension as said predetermined width dimension and a greater height dimension than the portion of said predetermined height dimension from the bottom edge of the check to the top edge of said preselected area;

a transfer medium supported on said support member, said transfer medium being of extent sufficient to encompass said preselected area when aligned with said preselected area;

and alignment means comprising a flange disposed on the lower portion of the width portion of said support member such that when said support member is placed adjacent the check with said flange of said alignment means engaging the bottom edge of the check said transfer medium becomes aligned with the preselected area of the check.

* * * * *